US006239691B1

(12) United States Patent
Preisler

(10) Patent No.: US 6,239,691 B1
(45) Date of Patent: May 29, 2001

(54) FLASHING LIGHT ASSEMBLY FOR USE ON A PORTABLE, TRAFFIC-CONTROL, SAFETY SIGN

(76) Inventor: Darius J. Preisler, 52497 Powderhorn, Macomb, MI (US) 48042

( * ) Notice: Subject to any disclaimer, the term of this patent is extended or adjusted under 35 U.S.C. 154(b) by 0 days.

(21) Appl. No.: 09/588,134

(22) Filed: Jun. 2, 2000

(51) Int. Cl.[7] ..... G08B 23/00

(52) U.S. Cl. ..... 340/321; 340/332; 340/693.5; 340/693.9; 40/586; 116/63 P; 362/109; 362/396; 362/812

(58) Field of Search ..... 340/321, 332, 340/693.5, 693.9; 362/109, 191, 368, 396, 812; 40/586; 116/63 P, 202

(56) References Cited

U.S. PATENT DOCUMENTS

| | | | | |
|---|---|---|---|---|
| 3,821,860 | | 7/1974 | Patty . | |
| 4,042,919 | | 8/1977 | Patty . | |
| 4,090,186 | | 5/1978 | Renner . | |
| 4,587,755 | * | 5/1986 | Sunshine | 340/321 |
| 4,959,637 | * | 9/1990 | Woods et al. | 340/321 |
| 5,276,424 | | 1/1994 | Hegemann . | |
| 5,440,464 | | 8/1995 | Nowlin et al. . | |
| 5,755,051 | | 5/1998 | Zumbuhl . | |
| 6,031,468 | * | 2/2000 | Tsao et al. | 340/321 |
| 6,035,567 | * | 3/2000 | Cameron | 340/321 |
| 6,134,820 | * | 10/2000 | Martinez | 340/321 |
| 6,150,957 | * | 11/2000 | Henz et al. | 340/321 |

* cited by examiner

*Primary Examiner*—Daniel J. Wu
(74) *Attorney, Agent, or Firm*—Brooks & Kushman P.C.

(57) ABSTRACT

A flashing light assembly for use on a portable, traffic-control, safety sign includes a bracket which allows the light assembly to be fastened to the safety sign without the need for special hardware or tools. The light assembly includes a lamp, an electrical circuit including a DC voltage source coupled to the lamp for controllably energizing the lamp so that the lamp flashes, and a housing for housing the electrical circuit. The bracket includes an upper wall portion connected to the housing and a pair of resilient side wall portions which receive and grip a retaining member of the safety sign. The lamp attracts attention to the sign by flashing when the sign is held in an upright position. The lamp may be a strobe or an incandescent lamp.

12 Claims, 1 Drawing Sheet

FLASHING LIGHT ASSEMBLY FOR USE ON A PORTABLE, TRAFFIC-CONTROL, SAFETY SIGN

TECHNICAL FIELD

This invention relates to flashing light assemblies for use on portable, traffic-control, safety signs.

BACKGROUND ART

Portable, traffic-control, safety signs are used by various individuals such as crossing guards to protect children going to and from school as well as road construction workers to protect their fellow workers.

U.S. Pat. No. 4,042,919 discloses a hand-held illuminated sign having a one-piece frame with a transparent border and an elongated light member.

U.S. Pat. No. 5,755,051 discloses a battery-powered warning light and sign having a handle and a sign-receiving bracket and a power switch located on the handle.

U.S. Pat. No. 5,276,424 discloses a hand-held, battery-powered stop sign including a plurality of individually flashing lights.

U.S. Pat. No. 5,440,464 discloses a light shroud for a highway sign that is hand-held and includes an indica-carrying display panel.

U.S. Pat. Nos. 4,090,186 and 3,821,860 disclose hand-held illuminated road signs that are battery-powered.

While the prior art generally shows lights associated with safety signs, there are thousands of safety signs currently in use which would have to be replaced with safety signs having lights if such safety signs were to be used. In other words, the cost associated with replacing currently used safety signs with safety signs having lights would be cost prohibitive.

DISCLOSURE OF INVENTION

An object of the present invention is to provide a flashing light assembly for use on a portable, traffic-control, safety sign wherein the light assembly can be easily fastened to the safety sign without using any special hardware or tools.

In carrying out the above object and other objects of the present invention, a flashing light assembly for use on a portable, traffic-control, safety sign is provided. The light assembly includes a lamp and an electrical circuit including a DC voltage source electrically coupled to the lamp for controllably energizing the lamp so that the lamp flashes. The light assembly also includes a housing for housing the electrical circuit and the lamp and a bracket having an upper wall portion for supporting the housing and a pair of spaced resilient side wall portions which are connected to and extend downwardly from the upper wall portion. The side wall portions define a channel therebetween and move apart to receive and grip a retaining member of the safety sign in the channel therebetween during mounting of the light assembly on the safety sign. The lamp attracts attention to the safety sign when the lamp is flashing.

The lamp may be an incandescent lamp or a strobe.

The electrical circuit preferably includes a switch such as a mercury switch which allows electrical current to flow to the lamp when the switch has a predetermined orientation in an upright position of the safety sign.

The light assembly may further include a plurality of teeth extending inwardly from both of the side wall portions and adapted to cooperate with the retaining member for affixing the light assembly on the safety sign during mounting of the light assembly on the safety sign.

The plurality of teeth may he adapted to bite into opposing surfaces of the sign to retain the retaining member within the channel.

The plurality of teeth may be adapted to engage a bottom surface of the engagement member to retain the retaining member within the channel.

Preferably, the DC voltage source includes at least one battery such as a rechargeable battery.

The bracket may be a snap-on bracket and the side wall portions define a snap-on channel. The side wall portions receive and grip the retaining member of the safety sign during snap-fit mounting of the light assembly on the safety sign. The teeth have inclined surfaces for cooperating with the retaining member for sliding the light assembly onto the retaining member.

The light assembly of the present invention is an easy-to-attach enhancement to preexisting traffic-control safety signs and attracts attention to the safety signs, thereby providing greater safety.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
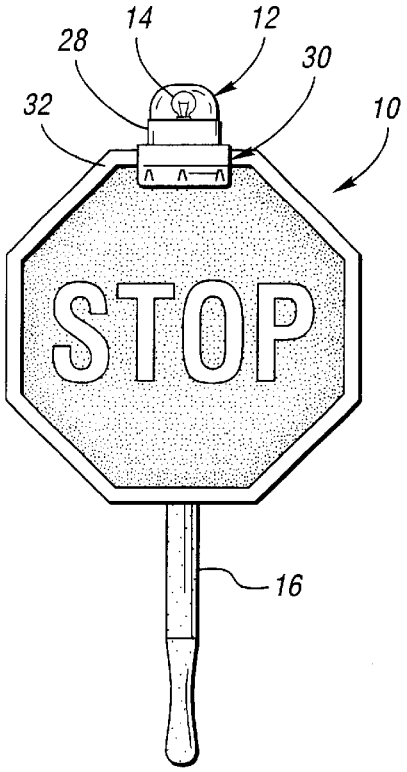
FIG. 1 is a front schematic view of a flashing light assembly of the present invention mounted on a portable, traffic-control, safety sign to attract attention to the safety sign.
Figure 4:
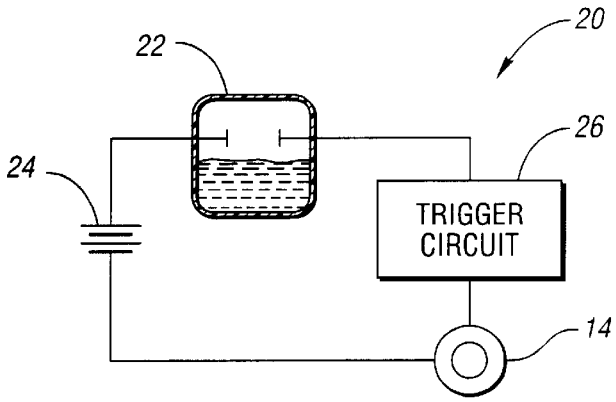
FIG. 4 is an electrical schematic of an electrical circuit of the flashing light assembly.

Referring now to the drawing Figures, there is illustrated in FIG. 1 a portable, traffic-control, safety sign, generally indicated at 10, including a battery-operated, flashing light assembly, generally indicated at 12, mounted on the safety sign 10. The light assembly 12 is fastened to a retaining member 32 of the sign 10 at the top of the sign 10, so as to attract attention to the sign 10. The safety sign 10 includes a pole or a handle 16 by which the sign 10 can be held in a vertical position.

Figure 2:
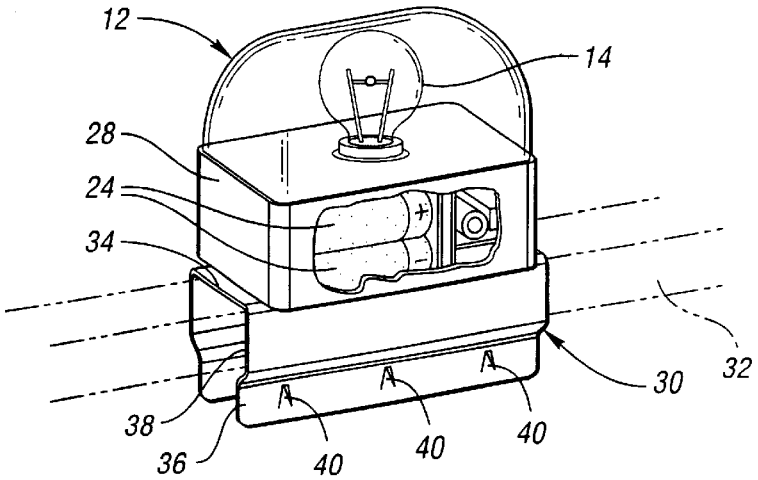
FIG. 2 is a perspective view, partially broken away, of the flashing light assembly fastened to a retaining member of the safety sign wherein the retaining member is indicated in phantom.
Figure 3:
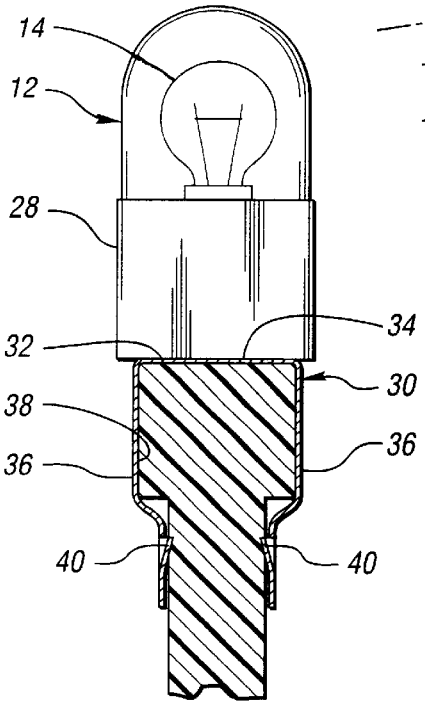
FIG. 3 is a sectional view of a snap-on bracket of the light assembly with the retaining member received and retained within a snap-on channel of the bracket.

The light assembly 12 includes a lamp 14 such as a strobe or an incandescent lamp and an electrical circuit, generally indicated at 20 in FIG. 3, which controllably energizes the lamp 14. The circuit 20 includes a DC voltage source 24 such as a pair of batteries which may be rechargeable. The circuit 20 also includes a switch 22 such as a mercury switch which allows electrical current to flow to the lamp 14, to energize the lamp 14 when the switch 22 is positioned in a predetermined orientation in the upright position of the safety sign 10, as illustrated in FIG. 1. The control circuit 20 further includes a conventional flashing or trigger circuit 26 to cause the lamp 14 to flash when energized. The control circuit 20 and the lamp 14 are contained or housed within a housing 28 as illustrated in FIGS. 1 and 2 wherein a top portion of the housing 28 is transparent.

The light assembly 12 further includes a bracket, generally indicated at 30, having an upper wall portion 34 connected to the housing 28 to allow snap-on mounting or fastening of the light assembly 12 on the retaining member 32 at a top of the traffic sign 10.

The bracket 30 also includes a pair of spaced resilient side wall portions 36 connected to opposite sides of the upper wall portion 34 and which define an extending snap-on channel 38 therebetween. Teeth 40 formed by piercing the side wall portions 36 extend inwardly from each of the side wall portions 36 and slide on the side surfaces of the retaining member 32 during mounting of the light assembly 12 to the safety sign 10. Inclined surfaces of the teeth 40 slidably contact the retaining member 32 during mounting onto the safety sign 10 to facilitate resilient displacement of the side wall portions 36. The side wall portions 36 pivotally travel away from each other in opposite directions allowing the retaining member 32 to enter and abuttingly engage the snap-on channel 38 thereby retaining the light assembly 12 on the safety sign 10.

The teeth 40 may bite into the side surfaces of the sign 10 as indicated in FIG. 3 or the teeth 40 may engage a bottom surface of the retaining member 32 to help retain the retaining member 32 within the snap-on channel 38.

While the best mode for carrying out the invention has been described in detail, those familiar with the art to which this invention relates will recognize various alternative designs and embodiments for practicing the invention as defined by the following claims.

What is claimed is:

1. A flashing light assembly for use on a portable, traffic-control, safety sign, the light assembly comprising:

a lamp;

an electrical circuit including a DC voltage source electrically coupled to the lamp for controllably energizing the lamp so that the lamp flashes;

a housing for housing the electrical circuit and the lamp; and a bracket having an upper wall portion for supporting the housing and a pair of spaced resilient side wall portions which are connected to and extend downwardly from the upper wall portion and which define a channel therebetween and which move apart to receive and grip a retaining member of the safety sign in the channel therebetween during mounting of the light assembly on the safety sign wherein the lamp attracts attention to the safety sign when the lamp is flashing.

2. The light assembly as claimed in claim 1 wherein the lamp is an incandescent lamp.

3. The light assembly as claimed in claim 1 wherein the lamp is a strobe.

4. The light assembly as claimed in claim 1 wherein the electrical circuit includes a switch which allows electrical current to flow to the lamp when the switch has a predetermined orientation in an upright position of the safety sign.

5. The light assembly as claimed in claim 4 wherein the switch is a mercury switch.

6. The light assembly as claimed in claim 1 further comprising a plurality of teeth extending inwardly from both of the side wall portions and adapted to cooperate with the retaining member for affixing the light assembly on the safety sign during mounting of the light assembly on the safety sign.

7. The light assembly as claimed in claim 6 wherein the plurality of teeth are adapted to bite into opposing side surfaces of the safety sign to retain the retaining member within the channel.

8. The light assembly as claimed in claim 6 wherein the plurality of teeth are adapted to engage a bottom surface of the engagement member to retain the retaining member within the channel.

9. The light assembly as claimed in claim 1 wherein the DC voltage source includes at least one battery.

10. The light assembly as claimed in claim 9 wherein the at least one battery is a rechargeable battery.

11. The light assembly as claimed in claim 1 wherein the bracket is a snap-on bracket and the side wall portions define a snap-on channel and wherein the side wall portions receive and grip the retaining member of the safety sign during snap-fit mounting of the light assembly on the safety sign.

12. The light assembly as claimed in claim 11 further comprising a plurality of teeth extending inwardly from both of the side wall portions, the teeth having inclined surfaces for cooperating with the retaining member for sliding the light assembly onto the retaining member.

* * * * *